US010245599B2

(12) United States Patent
Kosarnig

(10) Patent No.: US 10,245,599 B2
(45) Date of Patent: Apr. 2, 2019

(54) SPRAY NOZZLE

(71) Applicant: GEBERIT INTERNATIONAL AG, Jona (CH)

(72) Inventor: Rolf Kosarnig, Ruti (CH)

(73) Assignee: GEBERIT INTERNATIONAL AG, Jona (CH)

( * ) Notice: Subject to any disclaimer, the term of this patent is extended or adjusted under 35 U.S.C. 154(b) by 189 days.

(21) Appl. No.: 14/920,039

(22) Filed: Oct. 22, 2015

(65) Prior Publication Data

US 2016/0114347 A1 Apr. 28, 2016

(30) Foreign Application Priority Data

Oct. 22, 2014 (EP) ..... 14189907

(51) Int. Cl.

| | |
|---|---|
| ***B05B 1/00*** | (2006.01) |
| ***B05B 1/04*** | (2006.01) |
| ***E03D 13/00*** | (2006.01) |
| ***E03D 3/00*** | (2006.01) |
| ***B05B 15/60*** | (2018.01) |
| ***B05B 15/18*** | (2018.01) |
| ***B05B 15/65*** | (2018.01) |

(52) U.S. Cl.

CPC ..... *B05B 1/00* (2013.01); *B05B 1/046* (2013.01); *B05B 15/18* (2018.02); *B05B 15/60* (2018.02); *B05B 15/65* (2018.02); *E03D 3/00* (2013.01); *E03D 13/00* (2013.01)

(58) Field of Classification Search

USPC ..... 4/448

See application file for complete search history.

(56) References Cited

U.S. PATENT DOCUMENTS

| | | | | |
|---|---|---|---|---|
| 4,939,797 | A | 7/1990 | Goettl | |
| 7,708,212 | B1 | 5/2010 | Conn | |
| 2011/0010834 | A1* | 1/2011 | Park | B05B 15/065 4/448 |

FOREIGN PATENT DOCUMENTS

| | | | |
|---|---|---|---|
| DE | 7111723 | U | 7/1971 |
| DE | 7231248 | U | 2/1974 |
| JP | 08-239889 | A | 9/1996 |
| JP | 09078668 | A | 3/1997 |

OTHER PUBLICATIONS

European Search Report of EP 14189907.0 dated Apr. 30, 2015.

* cited by examiner

*Primary Examiner* — Lauren A Crane

(74) *Attorney, Agent, or Firm* — Sughrue Mion, PLLC

(57) ABSTRACT

A spray nozzle (1) for a sanitary article (2), in particular for a urinal, includes a nozzle head (3) which comprises a nozzle channel (4) which extends along a center axis (M) and has a nozzle inlet (5) and a nozzle outlet (6), and a pipe section (7) which comprises an interior (8) with an inlet (9), to which a water pipe (10) is connectable, and an outlet (11). The nozzle head (3) is mounted in the interior (8), wherein the nozzle inlet (5) is accessible from the interior (8) such that flushing water is able to enter into the nozzle channel (4) from the interior (8) and the nozzle outlet (6) projects out of the interior (8), and wherein the nozzle head (3) is secured with reference to the interior (8) of the pipe section (7) by means of a securing element (12).

18 Claims, 8 Drawing Sheets

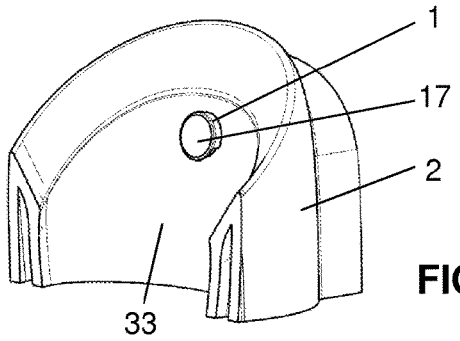
FIG. 13a
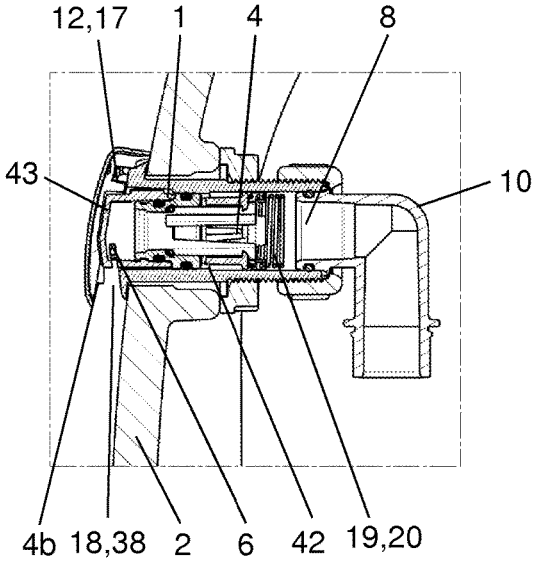
FIG. 13b
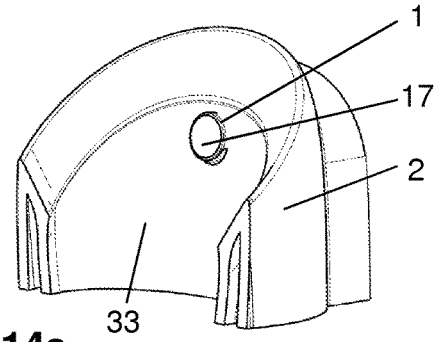
FIG. 14a
FIG. 14b
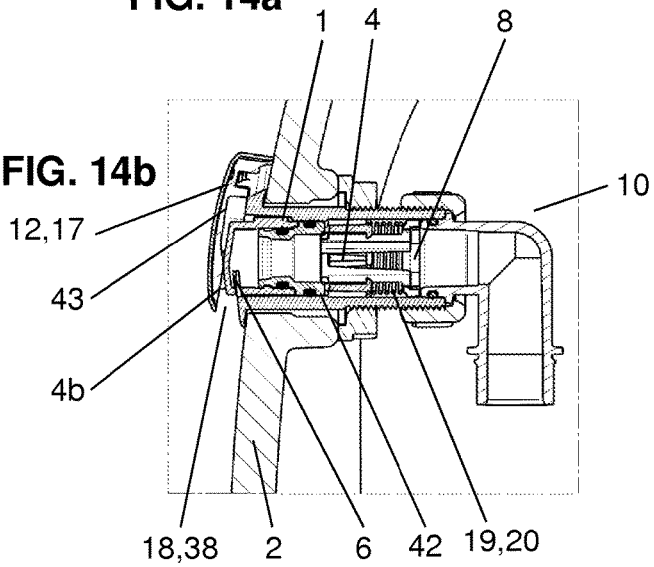

SPRAY NOZZLE

TECHNICAL FIELD

The present invention relates to a spray nozzle for a urinal according to the preamble of Claim 1.

PRIOR ART

Spray nozzles for urinals are known from the prior art. For example, DE 7111723 shows a spray head which is fitted onto a connection piece.

DE 7231248 shows a very similar spray head.

A disadvantage of spray heads from the prior art is that they are only partially suited to use in the public sector as they provide an attack point for acts of vandalism. For example, in the case of the spray head of DE 7111723, the closure cap can easily be removed, which is then to the detriment of the user because the water is no longer directed into the urinal, but in the direction of the user.

Furthermore, the spray nozzles according to the prior art have the disadvantage that they are not suited to triggering a flush that is economical with reference to water consumption.

SUMMARY OF THE INVENTION

Proceeding from said prior art, one object underlying the invention is to provide a spray nozzle for a sanitary article which overcomes the disadvantages of the prior art. In particular, the spray nozzle should be exchanged in as simple a manner as possible, in a particularly preferred manner without the assistance of a tool. Furthermore, a water distribution, which is always the same over the entire service life of the spray nozzle and also after the replacement thereof, is preferably to be achieved.

Said object is achieved by the object of Claim 1. Accordingly, a spray nozzle for a sanitary article, in particular for a urinal, comprises a nozzle head which comprises a nozzle channel, which extends along a centre axis and has a nozzle inlet and a nozzle outlet, and a pipe section which comprises an interior with an inlet, to which a water pipe is connectable, and an outlet. The nozzle head is mounted in the interior of the pipe section, wherein the nozzle inlet is accessible from the interior such that flushing water is able to enter into the nozzle channel from the interior of the pipe section and the nozzle outlet projects out of the interior and wherein the nozzle head is secured with reference to or to the interior of the pipe section by means of a securing element.

As a result of the bearing of the nozzle head in the interior of the pipe section, the nozzle head can be exchanged in a very simple manner. Only the nozzle head has to be replaced in the event of a defect, such as calcification, whereas the pipe section remains in the sanitary fitting. Consequently, the exchange of the actual nozzle is comparatively simple and an expensive and time-consuming disassembly of further components is omitted. In particular, undoing the connection between the spray nozzle and the water pipe is omitted.

Furthermore, the pipe section is independent of the dimensions of the sanitary article, as a result of which the necessary accuracy of fit between the nozzle head and the pipe section is achievable. When the nozzle head is changed, the pipe section forms an unchanging receiving means, as a result of which alignment tasks are omitted.

The securing element is preferably formed in such a manner that it is able to be released by hand, that is without the assistance of a tool.

The securing element can be located inside or outside the interior of the pipe section.

The pipe section itself is formed in such a manner that it can be mounted in the sanitary article. In this case, it is formed separately from the sanitary article and is therefore not part of the sanitary article, but a separate element.

The nozzle head and the pipe section are two parts that are formed separately from one another, wherein the nozzle head, as described above, being insertable into the interior of the pipe section. The pipe section serves, in other words, for the bearing of the nozzle head.

The nozzle head is preferably insertable into the interior by means of the outlet of the pipe section. The outlet of the pipe section, in this case, is placed in the installation position in such a manner that it is easily reachable, in particular from the front.

The nozzle head and the pipe section preferably include alignment elements such that, in its installation position, the nozzle head is mounted in the interior in a non-rotatable manner with reference to a movement about the central axis. As a result of the alignment elements, no twisting can occur between the nozzle head and the pipe section. Furthermore, when assembling or exchanging a nozzle head, the nozzle head to be inserted is always aligned in the same position with respect to the pipe section.

In a first preferred embodiment, the securing element is a groove and tongue connection between the nozzle head and the interior. One of the two elements, in this case, includes the tongue and the other the groove, the tongue engaging in the groove. In said first embodiment, the securing element is located inside the interior.

The groove is preferably arranged on the nozzle head and the tongue extends into the interior of the pipe section and is consequently part of the same. A reverse arrangement would also be conceivable.

The groove and tongue connection can be formed, for example, as a bayonet closure, wherein the groove and tongue connection comprise portions which extend in the direction of the centre axis and at right angles thereto.

In a particularly preferred manner, the said groove and tongue connection comprises at least one part portion which, with reference to the centre axis, is formed at least in part circumferential and extending along the centre axis in such a manner that a rotation of the nozzle head in the fixed interior results in an axial displacement along the centre axis. This is therefore a groove and tongue connection which, when viewed in the direction of the centre axis, comprises a gradient or inclination. The part portion can also be designated as thread-like. The advantage of said embodiment is that a rotation of the nozzle head about the centre axis results at the same time in a longitudinal movement along the centre axis, as a result of which the nozzle head can be assembled and disassembled in a simple manner. Calcifications in the interior can thus be easily separated off during removal.

In a particularly preferred embodiment, the said groove and tongue connection can provide not only the securing element but at the same time also the alignment element. To this end, in the groove, the said groove and tongue connection comprises a defined stop surface, against which the tongue abuts in the final installation position.

The spray nozzle according to the first embodiment preferably further includes a cover. The cover is in connection with the nozzle head and/or the pipe section, wherein, in the connected state, in the region of the nozzle outlet the cover maintains an interspace through which the water is suppliable from the nozzle outlet to the sanitary article. The connection between the cover and the nozzle head or pipe section is preferably formed as a latching connection, wherein the cover and the counterpart, that is to say the nozzle head and/or the pipe section, have corresponding latching elements.

In a second preferred embodiment, the securing element is a cover which is connectable to the pipe section and projects in such a manner over the outlet of the pipe section that, as a result of the cover, the nozzle head is opposed by a stop with reference to a movement out of the interior. In the second embodiment, the securing element is located outside the interior.

In the case of the second embodiment, a spring element, which presses the nozzle head in the direction of the cover in such a manner that the position of the nozzle head inside the pipe section when viewed along the centre axis is determined, is preferably arranged between the inlet of the pipe section and the nozzle head. The advantage of this is that, with reference to the position, the nozzle head can always be placed in the same manner in the interior when viewed in the direction of the central axis. However, a spring element can also be provided in the case of the first embodiment.

The spring element is preferably located in the interior.

The said spring element is preferably a compression spring. In a particularly preferred manner, the spring is in connection with guide parts. The compression spring with the guide parts includes a front end and a rear end as well as a guide part which is in connection with the front end and a guide part which is in connection with the rear end.

In a particularly preferred manner, the cover according to the second embodiment comprises a guide surface which is formed inclined at an angle to the centre axis and pushes the nozzle head into the interior when the cover is assembled. The nozzle head can therefore be pushed-in by means of the guide face, as a result of which the cover serves as an assembly aid.

According to all the above-described embodiments, on the outside the pipe section preferably comprises orientation elements which are formed in such a manner that they allow an alignment between the pipe section and the sanitary article with reference to a rotation about the centre axis. Consequently, the pipe section can always be placed in the same way and in an already correctly aligned manner in the sanitary article. In a preferred manner, the sanitary article comprises elements which cooperate with the orientation element, such as for example guide elements.

In a particularly preferred manner, a seal, which seals the gap with respect to water, is arranged in the gap between the outside surface of the nozzle head and the interior. The seal can be an O-ring seal, for example, which is mounted in a groove which runs around the nozzle head.

According to all the embodiments, the nozzle head, in a first variant, is formed in one-piece. In a second variant, the nozzle head can be formed as multiple parts with a nozzle part with the nozzle outlet and a bearing part with the nozzle inlet, wherein the nozzle channel extends through the nozzle part and the bearing part and wherein the two parts are fixedly connected with each other.

The pipe section is preferably connectable to a water pipe in the region of the inlet. To this end, the pipe section comprises suitable means, for example an external thread for connecting the pipe section to the water pipe by means of a cap nut.

According to all the embodiments, the nozzle head preferably comprises a lateral surface, which extends around the centre axis, and a front surface, wherein the nozzle inlet is arranged opposite the front surface and wherein the nozzle outlet penetrates the lateral surface in the region of the front surface. The nozzle inlet is defined substantially by the lateral surface.

In a particularly preferred manner, the nozzle outlet only extends in part around the centre axis and comprises an opening angle about the centre axis of a maximum of 180°, in particular of a maximum of 160°. In a particularly preferred manner, the opening angle is within a range of 90° and 180°.

In a particularly preferred manner, the cross section of the nozzle outlet when viewed in the direction of the centre axis varies over the circumference, wherein the cross section is preferably minimal in the region of the centre of the nozzle outlet. In other words, proceeding from the minimal width in the centre, the nozzle outlet widens on both sides until the maximum opening angle is obtained.

A sanitary article arrangement includes a sanitary article, in particular a urinal, having a collecting basin and an outlet as well as a spray nozzle according to the above description, wherein the nozzle outlet is aligned in such a manner that the collecting basin is wetted and the nozzle outlet is directed toward the outlet.

Further embodiments are provided in the dependent Claims.

BRIEF DESCRIPTION OF THE DRAWINGS

Preferred embodiments of the invention are described below by way of the drawings which serve purely for explanation and are not to be seen as restricting. In the drawings:

FIGS. 13*a*/13*b* show a perspective view and a sectional representation of the spray nozzle according to FIG. 10 in the installation position;

FIGS. 14*a*/14*b* show a perspective view and a sectional representation of the spray nozzle according to FIG. 10 during assembly or disassembly.

DESCRIPTION OF PREFERRED EMBODIMENTS

A perspective view of a spray nozzle 1 for a sanitary article 2, in particular for a urinal, is shown in the Figures. FIGS. 1 to 9 show a first embodiment and FIGS. 10 to 18 show a second embodiment.

Figure 1:
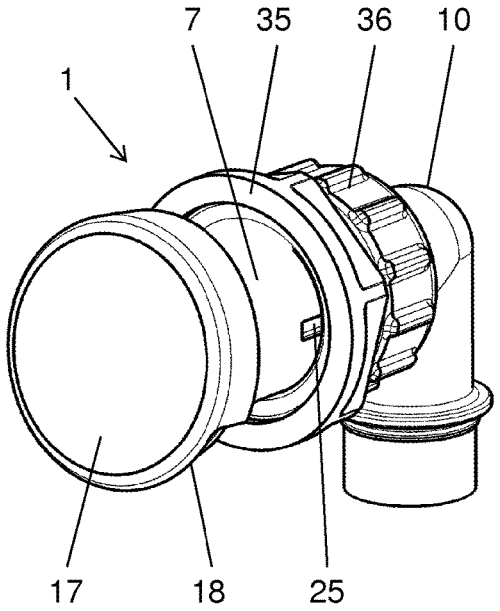
FIG. 1 shows a perspective view of a spray nozzle according to the present invention according to a first embodiment.
Figure 10:
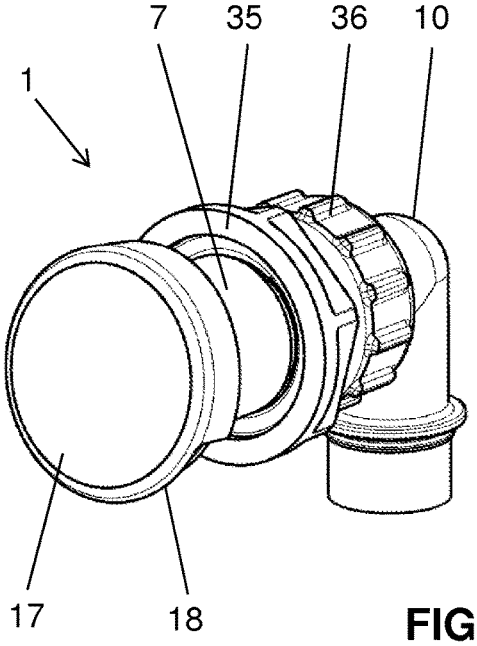
FIG. 10 shows a perspective view of a spray nozzle according to the present invention according to a second embodiment.

The spray nozzle 1 according to FIGS. 1 and 10 is shown in the mounted state without the sanitary article.

Figure 2:
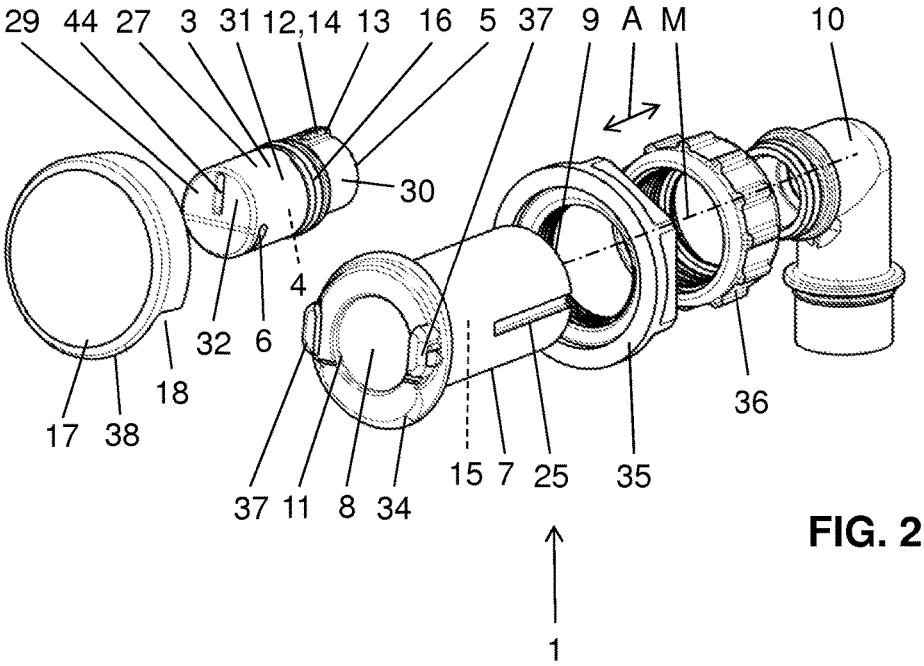
FIG. 2 shows a perspective exploded drawing of the spray nozzle according to FIG. 1.
Figure 11:
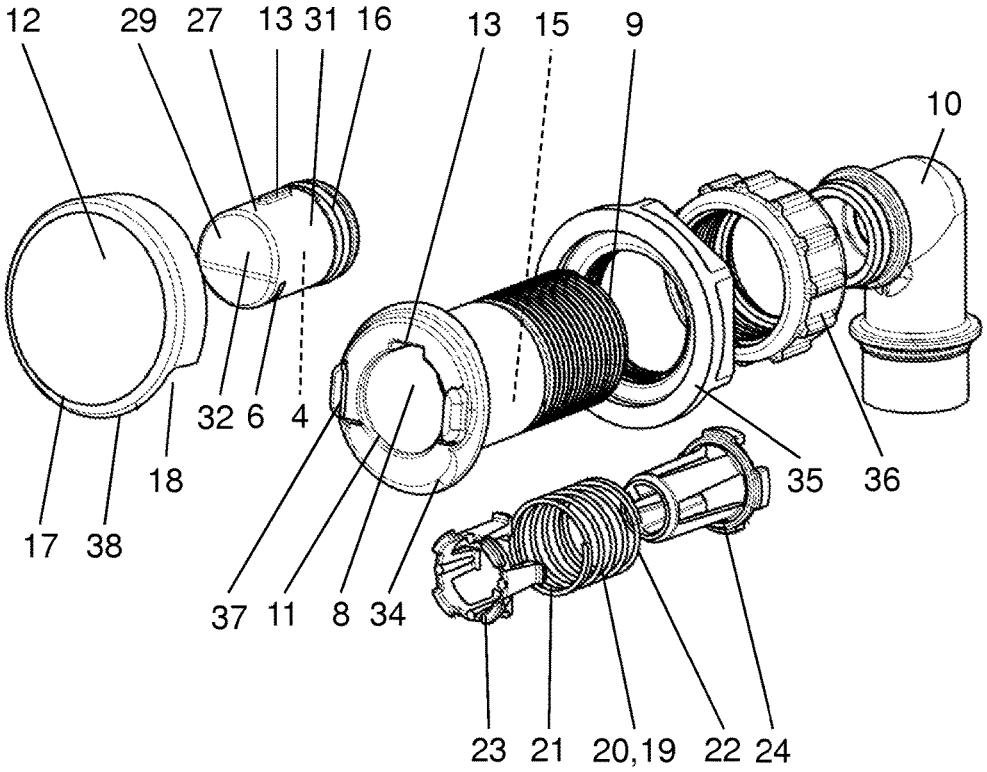
FIG. 11 shows a perspective exploded drawing of the spray nozzle according to FIG. 10.

FIGS. 2 and 11 show exploded drawings of the spray nozzle 1 according to the first embodiment and according to the second embodiment.

The spray nozzle 1 includes a nozzle head 3 which comprises a nozzle channel 4, which extends along a centre axis M and has a nozzle inlet 5 and a nozzle outlet 6, and a pipe section 7 which comprises an interior 8 with an inlet 9, to which a water pipe 10 is connectable, and an outlet 11. The nozzle head 3 is mounted in the interior 8 of the pipe section 7 and can be inserted into the interior 8 by means of the outlet 11. The nozzle inlet 5, in this case, is accessible from the interior 8 of the pipe section 7 in such a manner that flushing water is able to enter into the nozzle channel 4 of the nozzle head 3 from the interior 8. The nozzle head 3, in this case, is arranged in the interior 8 such that the nozzle outlet 6 projects out of the interior 8, in particular out of the outlet 11. The nozzle outlet 6 is therefore not in the interior 8 but is located in a correspondingly exposed manner such that flushing water is able to emerge from the nozzle outlet 6. The nozzle head 3 is secured or fixed in the interior 8 of the pipe section 7 by means of a securing element 12.

The securing element 12 according to the first embodiment according to FIGS. 1 to 9 is a groove and tongue connection 14, 15 and the securing element 12 according to the second embodiment according to FIGS. 10 to 18 is a cover 17. Said two embodiments are now explained in more detail below.

The pipe section 7 here comprises a circumferential flange 34 on the outside in the region of the outlet 11. The flange 34 serves as a stop element during assembly into the sanitary article 2. In addition, the spray nozzle 1 here includes a cap nut 35 which is connectable to the pipe section 7 such that it can be clamped to the sanitary article 2 together with the flange 34. There is an interspace, which serves for receiving parts of the sanitary article, between the cap nut 35 and the flange 34. In the assembled state, the pipe section 7 is in connection with the sanitary article. In the embodiment shown, it projects through an opening in the sanitary article 2.

Figure 3:
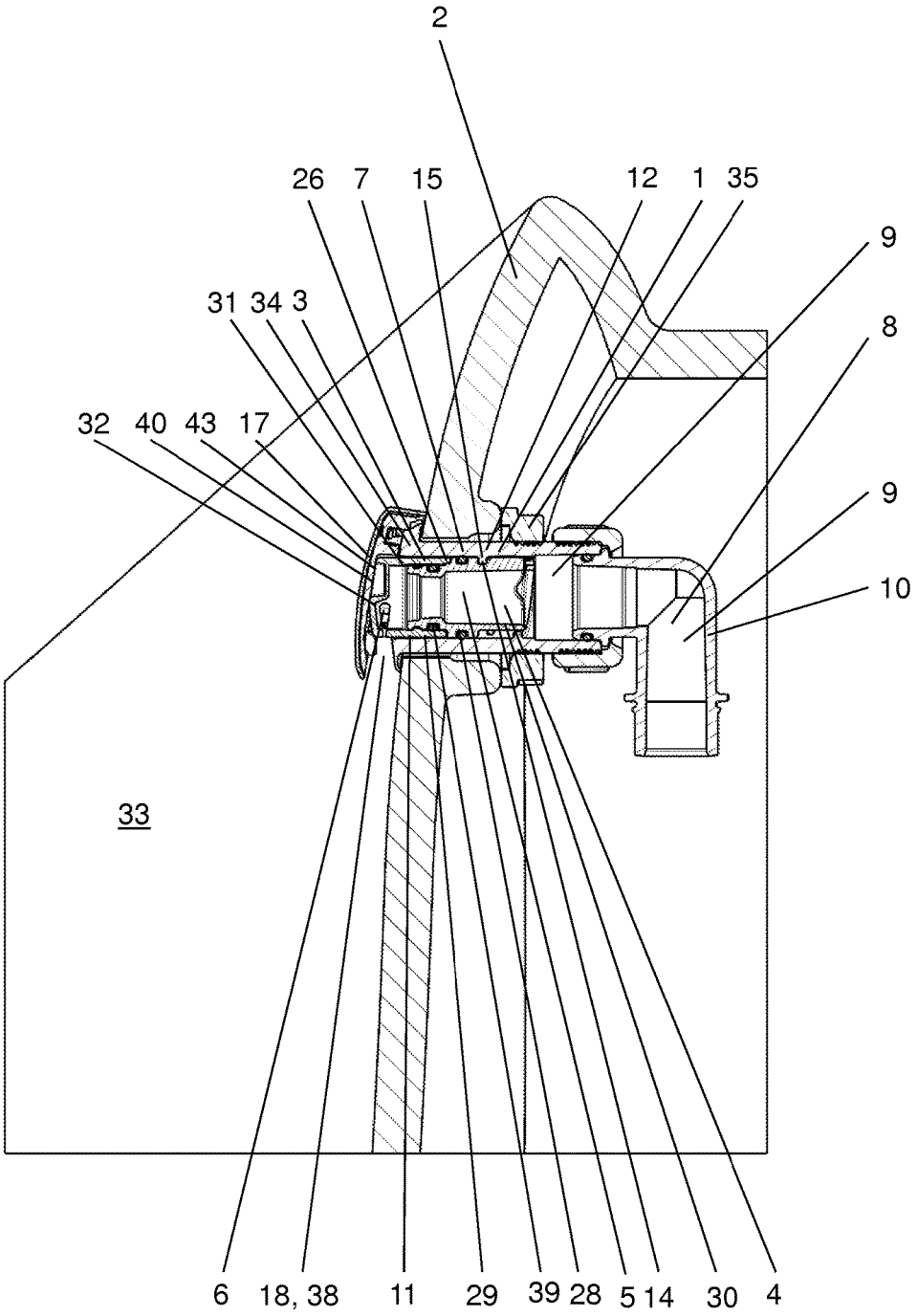
FIG. 3 shows a sectional representation of the spray nozzle according to FIG. 1 in the installation position.
Figure 12:
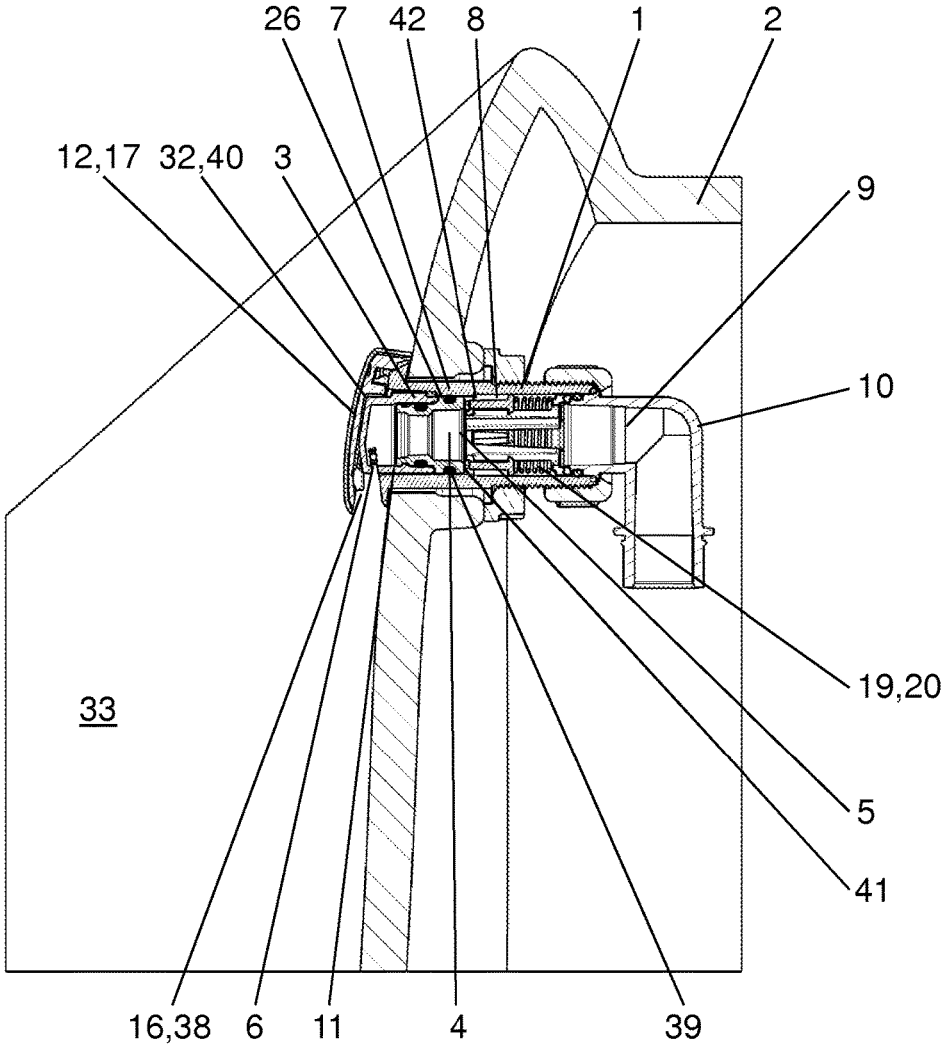
FIG. 12 shows a sectional representation of the spray nozzle according to FIG. 10 in the installation position.

In addition, FIGS. 3 and 12 show a section of the water pipe 10, here a curved section. The water pipe 10 projects into the interior 8 by means of the inlet 9 and is fastened to the pipe section 7 by way of a further cap nut 36. The threads for the cap nuts 35, 36, in this case, are arranged on the outside circumference of the pipe section 7.

In addition, in the embodiment shown, the nozzle head 3 and the pipe section 7 include alignment elements 13 such that the nozzle head 3 is mounted in its installation position in the interior 8 of the pipe section 7 in a non-rotatable manner with reference to a movement about the centre axis M. This consequently ensures that the nozzle outlet 6 is always in the correct orientation such that the sanitary article can be wetted or flushed in an appropriate manner. The correct orientation is shown in the sectional drawing of FIGS. 3 and 13. The nozzle outlet 6, in this case, is directed toward the collecting basin 33 of the sanitary article 2. Depending on the embodiment, the alignment elements 13 can be formed differently.

The securing element 12 according to the first embodiment of the spray nozzle 1 according to FIGS. 1 to 9 is in the form of a groove and tongue connection 14, 15 between the nozzle head 3 and the interior 8. Said connection can be seen particularly well in conjunction with FIGS. 2 and 3. FIG. 2 shows the groove 14 on the outside of the nozzle head 3. The tongue 15 is easy to recognize in FIG. 3. The tongue 15, in this case, projects into the interior 8 of the pipe section 7. The groove and tongue connection 14, 15 provides the nozzle head 3 with a stop against movement in the direction of the centre axis M in the interior 8.

The groove and tongue connection 14, 15 is preferably formed in such a manner that it comprises a part portion 16 which, with reference to the centre axis M, is formed at least in part circumferential and extending in a longitudinal direction along the centre axis M. The formation of the groove and tongue connection 14, 15 is accordingly in such a manner that a rotation of the nozzle head 3 in the fixed interior 8 results in an axial displacement A along the centre axis M.

Figure 4A:
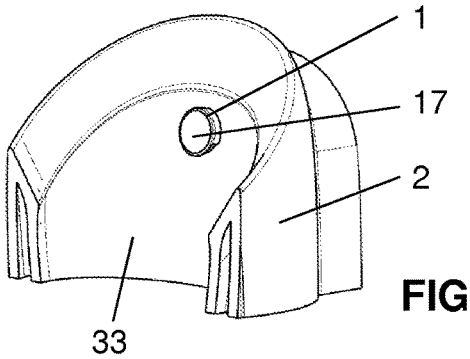
FIGS. 4*a*/4*b* show a perspective view and a sectional representation of the spray nozzle according to FIG. 1 in the installation position.
Figure 4B:
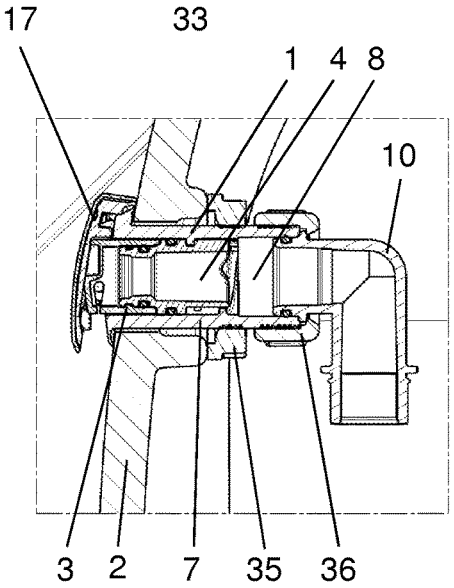
Figure 5A:
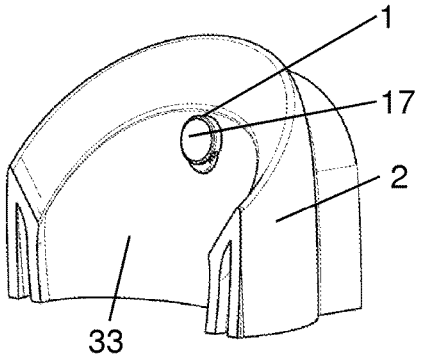
FIGS. 5*a*/5*b* show a perspective view and a sectional representation of the spray nozzle according to FIG. 1 during assembly or disassembly.
Figure 5B:
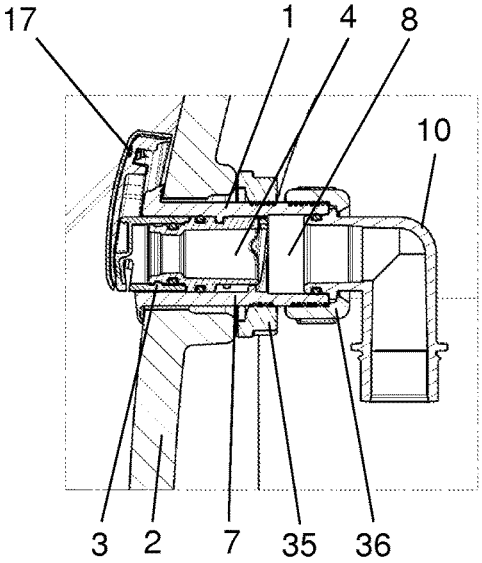
Figure 6:
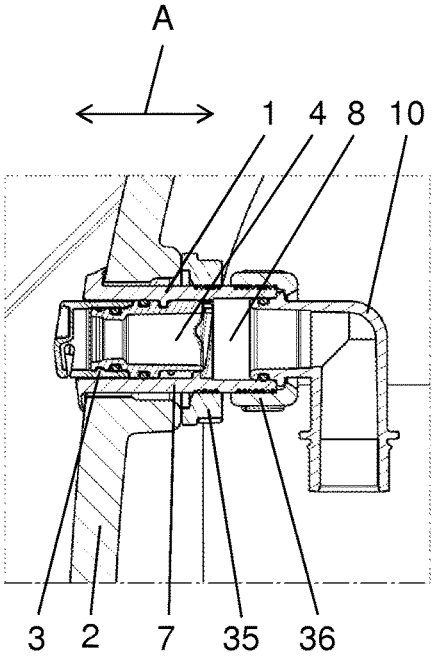
FIGS. 6-9 show further sectional representations of the spray nozzle according to FIG. 1 during assembly or disassembly.
Figure 7:
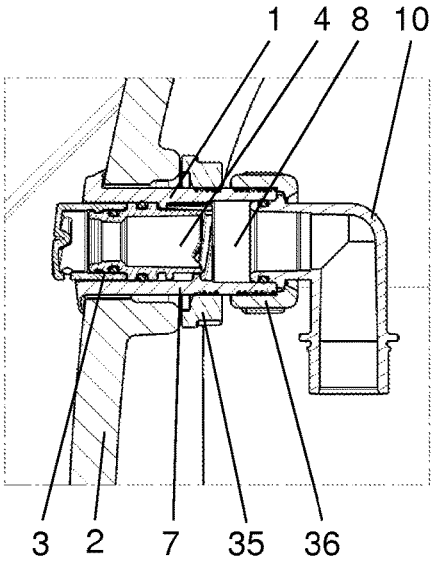
Figure 8:
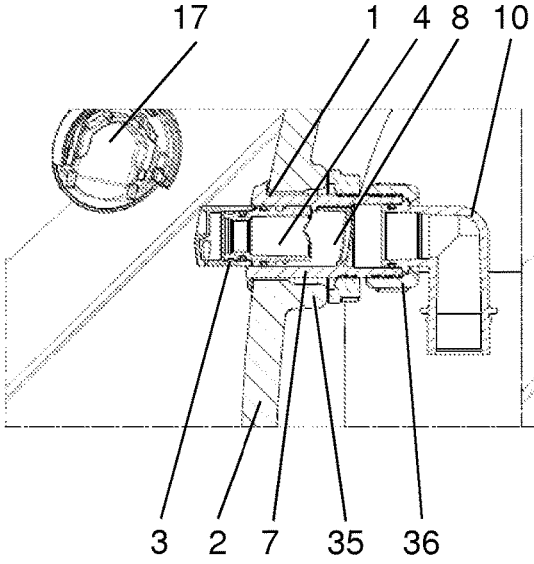
Figure 9:
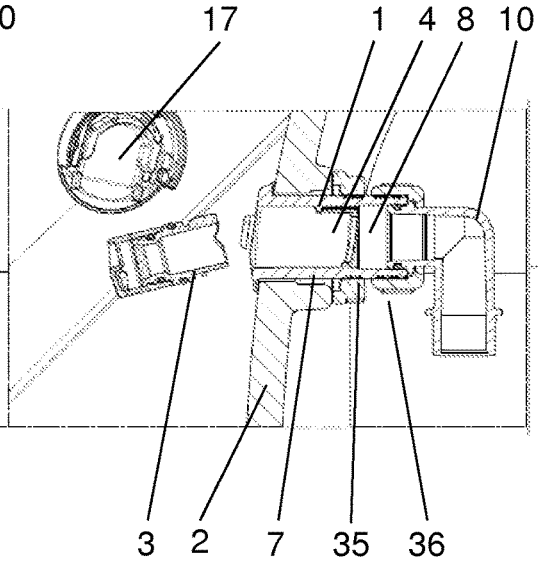

Said function of the groove and tongue connection 14, 15 is now explained more precisely by way of FIGS. 4*a* to 9. In FIG. 4*a* and the associated sectional representation 4*b*, the nozzle head 3 is located in its mounted position in the interior 8. In FIGS. 5*a* and 5*b*, a cover 17, which covers the nozzle head 3 at the front side, is removed and the nozzle head 3 is accessible to the installer. The accessibility is shown more precisely in FIG. 6. Proceeding from FIG. 6, the installer is able to pivot the nozzle head 3 about the centre axis M out of its initial position. FIG. 7 shows the nozzle head 3 in a pivot position. It can be recognized that the nozzle head 3 has been easily moved out of the interior 8 and that the tongue 15 is no longer completely engaged in the groove 14. When pivoted further about the centre axis M and, where applicable, subsequently displaced along the centre axis M, the nozzle head 3 is finally removed out of the interior 8, as is shown in FIGS. 8 and 9. Consequently, a mounted nozzle head 3 can be removed very simply out of the interior 8 of the pipe section 7.

The assembly of the nozzle head 3 into the interior 8 of the pipe section 7 is effected in the reverse direction. In this case, the installer inserts the nozzle head 3 into the interior 8, as shown in FIGS. 9 and 8. As soon as the groove 14 and the tongue 15 form a connection, the nozzle head 3 can be pivoted about its centre axis M, as is shown in FIG. 7. As a result, the nozzle head 3 is then moved into its end position, which is shown in FIG. 6. The cover 17 is then subsequently also mounted, as shown in FIGS. 5*a* and 5*b*, such that the nozzle head 3 is not visible from the front.

The nozzle head 3 can be provided with an optional slot 44 at the front side such that if there is serious calcification between the nozzle head 3 and the interior 8 of the nozzle head 3, the nozzle head 3 is pivotable using a screwdriver.

The groove and tongue connection 14, 15 also provides the alignment element 13 in the embodiment shown in the Figures. To this end, the groove and tongue connection 14, 15 comprises an end stop, the tongue abutting against a groove end and a further rotation not being possible.

However, the groove and tongue connection 14, 15 can also be formed in such a manner that when the nozzle head 3 is rotated about the centre axis M, no movement is effected in the direction of the centre axis M. The nozzle head 3 is then formed as a bayonet closure.

The said cover 17 is in connection with the pipe section 7. The pipe section 7 comprises a latching element 37, on which the cover 17 can be latched, for this purpose in the region of the flange 35. As an alternative to this, the cover can also be fastened on the nozzle head 3, a latching connection also being provided between the nozzle head 3 and the cover 17.

As shown in FIG. 3, the cover 17 is arranged in such a manner, in this case, that, in the connected state, in the region of the nozzle outlet 6 it maintains an interspace 18 through which the water from the nozzle outlet 6 is suppliable to the sanitary article. The interspace 18 is provided here by the cover 17 and by the collecting basin 33 of the sanitary article 2. The cover 17 comprises a recess 38 on its circumferential edge for providing the interspace 18.

FIGS. 10 to 12, as explained above, show the second embodiment of the spray nozzle 1. The spray nozzle 1 according to the second embodiment includes substantially the same elements as the spray nozzle 1 according to the first embodiment, wherein essentially the securing element 12 is formed in a different manner. The securing element 12 of the spray nozzle 1 according to the second embodiment is a cover 17. This means that the cover 17 provides the securing element for the nozzle head 3 such that it cannot fall out of the interior 8. The cover 17 is connectable to the pipe section 7 by means of a latching connection 37 in such a manner that the cover 17 projects over the outlet 11 of the pipe section 7. As a result, the cover 17 provides the nozzle head 3 with a stop with reference to a movement out of the interior 8. The action of the cover 17 as a stop can easily be seen in FIG. 12. FIG. 12 shows that the nozzle head 3 abuts against the inside surface 40 of the cover 17 by way of its front surface 32. The inside surface 40 and the front surface 32 therefore provide the actual stop.

Figure 17:
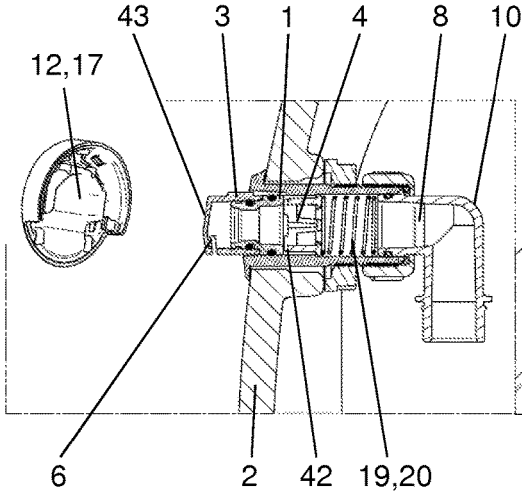

A spring element 19 is arranged between the inlet of the pipe section 7 and the nozzle head 3 according to the second embodiment. The spring element 19 presses the nozzle head 3 in the direction of the cover 17 such that the position of the nozzle head 3 within the pipe section 7 when viewed along the centre axis M is defined. The spring element 19 here is a compression spring 20 which presses onto the rear edge 41 of the nozzle head 3 and abuts against the water pipe 10. The spring element could also abut against an elevation which extends into the interior 8 instead of the water pipe 10. The spring element includes, as already mentioned, a compression spring 20 which comprises a front end 21 and a rear end 22. The spring element 19 here further includes a guide part 23 which is in connection with the front end 21 and a guide part 24 which is in connection with the rear end 22. The guide parts provide good guidance and delimit the spring deflection of the spring 20 inside the interior 8. The spring 20 is arranged in the interior 8 in such a manner that it is flowed through or flowed around correspondingly by the flushing water. FIG. 17 shows that the guide part 24 can abut against an inside surface 42 of the interior and consequently the spring element is prevented from being removed out of the interior when the nozzle head 3 is exchanged.

The cover 17 comprises an inside surface 40, as is shown in FIG. 12. The inside surface 40 not only serves as a stop surface but can also have the function of a guide surface. The guide surface is formed in portions inclined at an angle with respect to the centre axis M and ensures that the nozzle head 3 is inserted into the interior 8 against the spring force of the compression spring 20 when the cover 17 is mounted along a direction inclined at an angle with respect to the centre axis M. In this respect, the guide surface is an aid during assembly. In the present exemplary embodiment, the guide surface 40 is located with reference to the recess 43 such that, during assembly, the front surface 32 comes into contact with the guide surface 40 first of all and only then moves into the recess 43.

Figure 15:
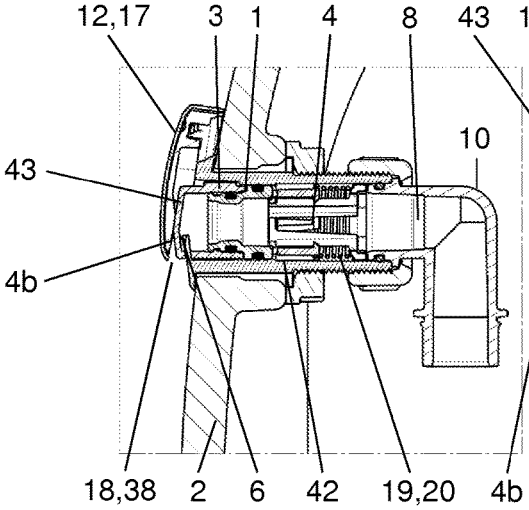
FIGS. 15-18 show further sectional representations of the spray nozzle according to FIG. 10 during assembly or disassembly.
Figure 16:
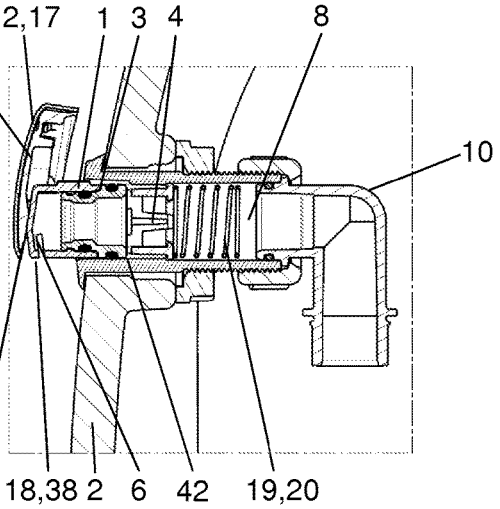

FIGS. 13 to 18 then show the disassembly of the nozzle head 3 according to the second embodiment. In a first step, as shown in FIGS. 13*a* to 14*b*, the cover 17, in the form of the securing element 12, is separated from the pipe section 7. In this connection, the latching connection between the cover 17 and the pipe section 7 is correspondingly lifted. Said lifted latching connection is shown in FIG. 15. As soon as the latching connection is lifted completely, the spring force of the spring element 19 presses the nozzle head 3 out of the interior 8 in the direction of the outlet 11 thereof. Consequently, the sanitary installer is able to take hold of the nozzle head 3 and remove it completely out of the interior 8.

The alignment element 13 according to the second embodiment is provided by a groove in the interior 8 and by a tongue on the lateral surface 31 of the nozzle head. The groove and tongue are oriented parallel to the centre axis M.

Figure 18:
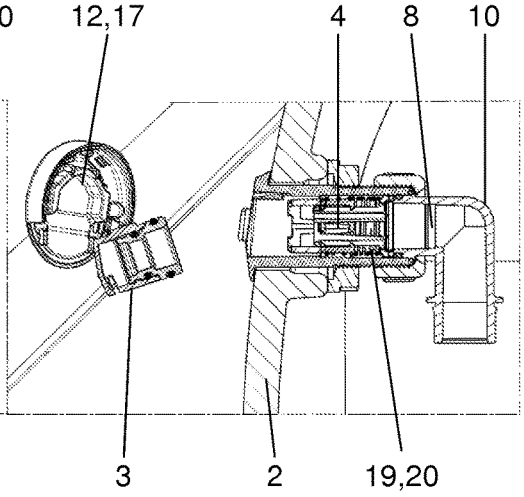

The assembly of the nozzle head 3 according to the second embodiment is effected in the reverse order to the disassembly just described. FIG. 18 shows the insertion of the nozzle head 3. The nozzle head 3 according to FIGS. 17 to 15 is then pushed further into the interior 8. The cover 17 can be used as an aid to this end. The cover 17 is then displaced relative to the pipe section 7, as shown in FIGS. 15 to 13, until the cover 17 forms a latching connection with the pipe section 7.

It can additionally be seen from FIG. 17 that along with the angular inclination, the guide surface includes another recess 43 into which the front surface 32 of the nozzle head 3 can project in a suitably fitting manner.

A few further features of the spray nozzle 1 according to the two described embodiments are now subsequently explained.

The pipe section 7, as shown in FIG. 2, preferably in both embodiments, includes orientation elements 25 on the outside. The pipe section 7 as such can be aligned relative to the sanitary article 2 by means of said orientation elements 25. In a preferred manner, the orientation elements 25 are grooves which extend in the direction of the centre axis M. The sanitary article 2 comprises corresponding counter elements which engage in the grooves. The orientation elements 25 can, however, also be formed differently.

It can easily be seen from the sectional representations of FIGS. 3 and 12 that a seal 28, which seals the gap 26 with respect to water, is arranged in the gap 26 between the outside surface 27 of the nozzle head 3 and the interior 8. The seal 28 is preferably an O-ring seal and prevents water being able to emerge through the gap between the outside surface 27 of the nozzle head 3 and the interior 8.

In addition, the path of the water is explained even more precisely by way of FIGS. 3 and 12. The water enters the interior 8 of the pipe section 7 by means of the water pipe 10. From the interior 8, the water then enters into the nozzle channel 4 of the nozzle head 3 by means of the nozzle inlet 5 and then flows along the nozzle channel 4 as far as the nozzle outlet 6, from where it then leaves the nozzle head 3 and consequently also the spray nozzle 1 in the direction of the sanitary article 2.

The nozzle head 3, as shown in FIGS. 3 and 12, is formed in multiple parts and has a nozzle part 29 with the nozzle outlet 6 and a bearing part 30 with the nozzle inlet 5. The nozzle part 29 and the bearing part 30, in this case, are fixedly connected with each other. The nozzle channel 6 extends through the nozzle part 29 and the bearing part 30. A seal 39 is also arranged here between the two parts 29, 30. In an alternative embodiment, the nozzle head 3 can also be formed in one-piece.

With reference to its shape, the nozzle head 3, irrespective of whether it is formed in one-piece or in multiple parts, comprises a lateral surface 31, which extends around the centre axis M, and a front surface 32. The lateral surface 31 and the front surface 32, in this case, delimit the nozzle channel 4. The nozzle inlet 5, in this case, is arranged opposite the front surface 32 and the nozzle outlet 6 is arranged in the region of the front surface 32. The nozzle outlet 6 penetrates the lateral surface 31 close to the front surface 32.

As shown in FIGS. 3 and 12, the nozzle outlet 6 does not extend completely around the centre axis M, but only partially. In a particularly preferred manner, the nozzle outlet 6 comprises an opening angle of a maximum of 180°, in particular a maximum of 160°. In other words, this means that the nozzle outlet 6 does not completely extend all round the centre axis M, but only partially round it.

The nozzle body 3 is arranged with reference to the sanitary fitting in such a manner that the nozzle outlet 6 is oriented downwards, that is into the collecting basin 33.

The cross section of the nozzle outlet 6 can be variable or constant over the circumference. From the embodiment shown, the cross section is minimal in the region of the centre of the nozzle outlet 6 and then becomes larger toward the ends of the nozzle outlet 6.

LIST OF REFERENCES

1 Spray nozzle
2 Sanitary article
3 Nozzle head
4 Nozzle channel
5 Nozzle inlet
6 Nozzle outlet
7 Pipe section
8 Interior
9 Inlet
10 Water pipe
11 Outlet
12 Securing element
13 Alignment element
14 Groove
15 Tongue
16 Part portion
17 Cover
18 Interspace
19 Spring element
20 Compression spring
21 Front end
22 Rear end
23 Guide part
24 Guide part
25 Orientation element
26 Gap
27 Outside surface
28 Seal
29 Nozzle part
30 Bearing part
31 Lateral surface
32 Front surface
33 Collecting basin
34 Flange
35 Cap nut
36 Cap nut
37 Latching connection
38 Recess
39 Seal
40 Inside surface
41 Rear edge
42 Inside surface
43 Recess
44 Slot
A Axial displacement
A Axial displacement
M Centre axis

The invention claimed is:

1. A spray nozzle for a sanitary article, in particular for a urinal, said spray nozzle comprising:

a nozzle head which comprises a nozzle channel which extends along a center axis and has a nozzle inlet and a nozzle outlet, a pipe section which comprises an interior with an inlet, to which a water pipe is connectable, and an outlet, and a cover which covers the nozzle head at its front side and which is in connection with the pipe section, wherein, in the connected state, in the region of the nozzle outlet, the cover maintains an interspace through which the water is suppliable from the nozzle outlet to the sanitary article, wherein the nozzle head is mounted in the interior, wherein the nozzle inlet is accessible from the interior such that flushing water is able to enter into the nozzle channel from the interior and the nozzle outlet projects out of the interior, wherein the nozzle head is secured with reference to the interior of the pipe section by means of a securing element, wherein the securing element is a groove and tongue connection between the nozzle head and the interior;

wherein said groove and tongue connection comprises at least one part portion which, with reference to the center axis, is formed at least in part circumferential and extending along the center axis in such a manner that a rotation of the nozzle head in the fixed interior results in an axial displacement along the center axis;

wherein the nozzle head and the pipe section include alignment elements such that, in its installation position, the nozzle head is mounted in the interior so as to be non-rotatable with reference to a movement about the center axis; and wherein said groove and tongue connection provides the alignment element.

2. The spray nozzle according to claim 1, wherein the nozzle head is insertable into the interior by means of the outlet of the pipe section.

3. The spray nozzle according to claim 1, wherein a spring element, which presses the nozzle head in the direction of the cover in such a manner that the position of the nozzle head inside the pipe section when viewed along the center axis is determined, is arranged between the inlet of the pipe section and the nozzle head.

4. The spray nozzle according to claim 3, wherein the spring element is a compression spring, or wherein the spring element includes a compression spring with a front end and a rear end as well as a guide part which is in connection with the front end and a guide part which is in connection with the rear end.

5. The spray nozzle according to claim 1, wherein the securing element is a cover which is connectable to the pipe section and projects in such a manner over the outlet that, as a result of the cover, the nozzle head is opposed by a stop with reference to a movement out of the interior.

6. The spray nozzle according to claim 5, wherein a spring element, which presses the nozzle head in the direction of the cover in such a manner that the position of the nozzle head inside the pipe section when viewed along the center axis (M) is determined, is arranged between the inlet of the pipe section and the nozzle head.

7. The spray nozzle according to claim 6, wherein the spring element is a compression spring, or wherein the spring element includes a compression spring with a front end and a rear end as well as a guide part which is in connection with the front end and a guide part which is in connection with the rear end.

8. The spray nozzle according claim 5, wherein the cover comprises a guide surface, which is formed inclined at an angle with respect to the center axis and pushes the nozzle head into the interior when the cover is assembled.

9. The spray nozzle according to claim 1, wherein on the outside the pipe section comprises orientation elements which are formed in such a manner that they allow an alignment between the pipe section and the sanitary article with reference to a rotation about the centre axis.

10. The spray nozzle according to claim 1, wherein a seal, which seals the gap with respect to water, is arranged in the gap between the outside surface of the nozzle head and the interior.

11. The spray nozzle according to claim 1, wherein the nozzle head is formed in one-piece.

12. The spray nozzle according to claim 1, wherein the nozzle head is formed in multiple parts with a nozzle part with the nozzle outlet and a bearing part with the nozzle inlet, wherein the nozzle channel extends through the nozzle part and the bearing part and wherein the two parts are fixedly connected with each other.

13. The spray nozzle according to claim 1, wherein the pipe section is connectable to a water pipe in the region of the inlet.

14. The spray nozzle according to claim 13, wherein the nozzle head comprises a lateral surface which extends around the center axis and a front surface, wherein the nozzle inlet is arranged opposite the front surface and wherein the nozzle outlet penetrates the lateral surface in the region of the front surface.

15. The spray nozzle according to claim 14, wherein the nozzle outlet only extends in part around the center axis and comprises an opening angle of a maximum of 180, in particular of a maximum of 160, in a particularly preferred manner of between 90 and 180.

16. The spray nozzle according to claim 14 wherein the cross section of the nozzle outlet when viewed in the direction of the center axis varies over the circumference, wherein the cross section is preferably minimal in the region of the center of the nozzle outlet.

17. The spray nozzle according to claim 14, wherein the nozzle outlet only extends in part around the center axis and comprises an opening angle of a maximum of 180°, in particular of a maximum of 160°, in a particularly preferred manner of between 90° and 180°, and wherein the cross section of the nozzle outlet when viewed in the direction of the center axis varies over the circumference, wherein the cross section is preferably minimal in the region of the centre of the nozzle outlet.

18. A sanitary article arrangement including a sanitary article, in particular a urinal, having a collecting basin and an outlet as well as a spray nozzle according to claim 1, wherein the nozzle outlet is aligned in such a manner that the collecting basin is wetted and the nozzle outlet is directed toward the outlet.

* * * * *